United States Patent [19]

Walter et al.

[11] Patent Number: 4,697,055

[45] Date of Patent: Sep. 29, 1987

[54] ARC EXTINCTION DEVICE FOR GAS INSULATION ELECTRICAL SWITCHGEAR

[75] Inventors: Jean-Jacques Walter, Boulogne; Daniel Petit, Paris; Joseph Marzocca, Grenoble; Jean Amalric, Meylan; Georges Bernard, St. Egrève, all of France

[73] Assignee: Merlin Gerin, France

[21] Appl. No.: 841,866

[22] PCT Filed: Jun. 5, 1985

[86] PCT No.: PCT/FR85/00141

§ 371 Date: Feb. 4, 1986

§ 102(e) Date: Feb. 4, 1986

[87] PCT Pub. No.: WO86/00169

PCT Pub. Date: Jan. 3, 1986

[30] Foreign Application Priority Data

Jun. 8, 1984 [FR] France ..... 84 09056

[51] Int. Cl.[4] ..... H01H 33/64

[52] U.S. Cl. ..... 200/148 B; 200/148 R; 200/148 C

[58] Field of Search ..... 200/148 B, 148 R, 148 C

[56] References Cited

U.S. PATENT DOCUMENTS

| | | | |
|---|---|---|---|
| 1,706,746 | 3/1929 | Rice | 200/148 B |
| 1,987,885 | 1/1935 | Whitney et al. | 200/148 C |
| 2,786,119 | 3/1957 | Forwald | 200/148 B |
| 4,052,577 | 10/1977 | Votta | 200/148 B |
| 4,117,528 | 9/1978 | Bolin | 200/148 B |
| 4,264,795 | 4/1981 | Sasao et al. | 200/148 B |
| 4,286,128 | 8/1981 | Ruffleux et al. | 200/148 B |
| 4,329,551 | 5/1982 | Bernard et al. | 200/148 B |

FOREIGN PATENT DOCUMENTS

| | | |
|---|---|---|
| 0004213 | 9/1979 | European Pat. Off. . |
| 735603 | 5/1943 | Fed. Rep. of Germany . |
| 40391 | 6/1932 | France . |
| 2385212 | 10/1978 | France . |
| 2479553 | 2/1981 | France . |
| 1593994 | 7/1981 | United Kingdom . |

*Primary Examiner*—Robert S. Macon

*Attorney, Agent, or Firm*—Parkhurst & Oliff

[57] ABSTRACT

The invention relates to an arc extinction device for SF6 insulated electrical switchgear.

A divisional arc chute 58 comprises a wall 58 with a convex revolution lateral surface, notably spherical, opposite the separation area 20, 22 of the contacts 20, 22, so as to form an acoustic resonator reflecting the pressure waves inwardly, causing the gases to converge towards the center of the sphere. At least one of the contacts is hollow and constitutes an outflow duct, for the gases from the arc chute 18 to a discharge chamber.

9 Claims, 7 Drawing Figures

ARC EXTINCTION DEVICE FOR GAS INSULATION ELECTRICAL SWITCHGEAR

The invention relates to an arc extinction device for a self-expansion and gas insulation electrical switch or circuit breaker comprising:

- a sealed housing filled with high dielectric strength insulating gas, notably sulphur hexafluoride,
- a divisional arc chute inside said housing,
- a pair of separable contacts located in said arc chute, at least one of the contacts being hollow,
- a gas outflow duct from said arc chute to a discharge chamber, in which expansion of the gas initially compressed in the arc chute takes place, under the action of the arc drawn between the contacts separated when the circuit breaker opens,
- and connection terminals, in electrical connection with said contacts.

A prior art circuit breaker of this kind is described in French Pat. Nos. 2,515,418 and 2,418,963 filed by the applicant. The divisional arc chute containing the contacts is formed by a cylindrical-shaped housing. Breaking tests have shown a certain off-centering of the arc drawn between the separated annular electrodes of the contacts. This arc off-centering problem leads to an increase in the breaking time which limits the performance of the switchgear.

The object of the invention is to improve the arc centering in a gas insulation circuit breaker or switch, notably of the self-expansion and/or rotating arc type, and to increase the breaking performances of the circuit breaker.

The arc extinction device according to the invention is characterized by the fact that the divisional arc chute comprises opposite the contact separation area a curved side revolution surface of a non linear curve, notably convex or concave, in such a way as to form an acoustic resonator reflecting the pressure waves inward, causing the gases to converge towards said separation area, and that the separable contacts are located in the vicinity of the middle area of said arc chute.

According to an embodiment of the invention, the wall of the arc chute has a spherical shape or spherical cross-section such that the acoustic resonator has a vibration antinode in the center of the sphere.

According to an alternative embodiment of the invention, the arc chute has an ellipsoidal shape arranged in such a way that the contacts are located apreciably at the level of the two focal spots in the circuit breaker open position. This results in better centering of the arc, in particular in the vicinity of the electrodes.

At least one of the contacts can be fitted with a permanent magnet or an electromagnetic coil to cause the arc to rotate inside the arc chute.

The wall of the arc chute is made of an insulating material, notably epoxy resin based, or of any other material having a high reflection coefficient.

Figure 1:
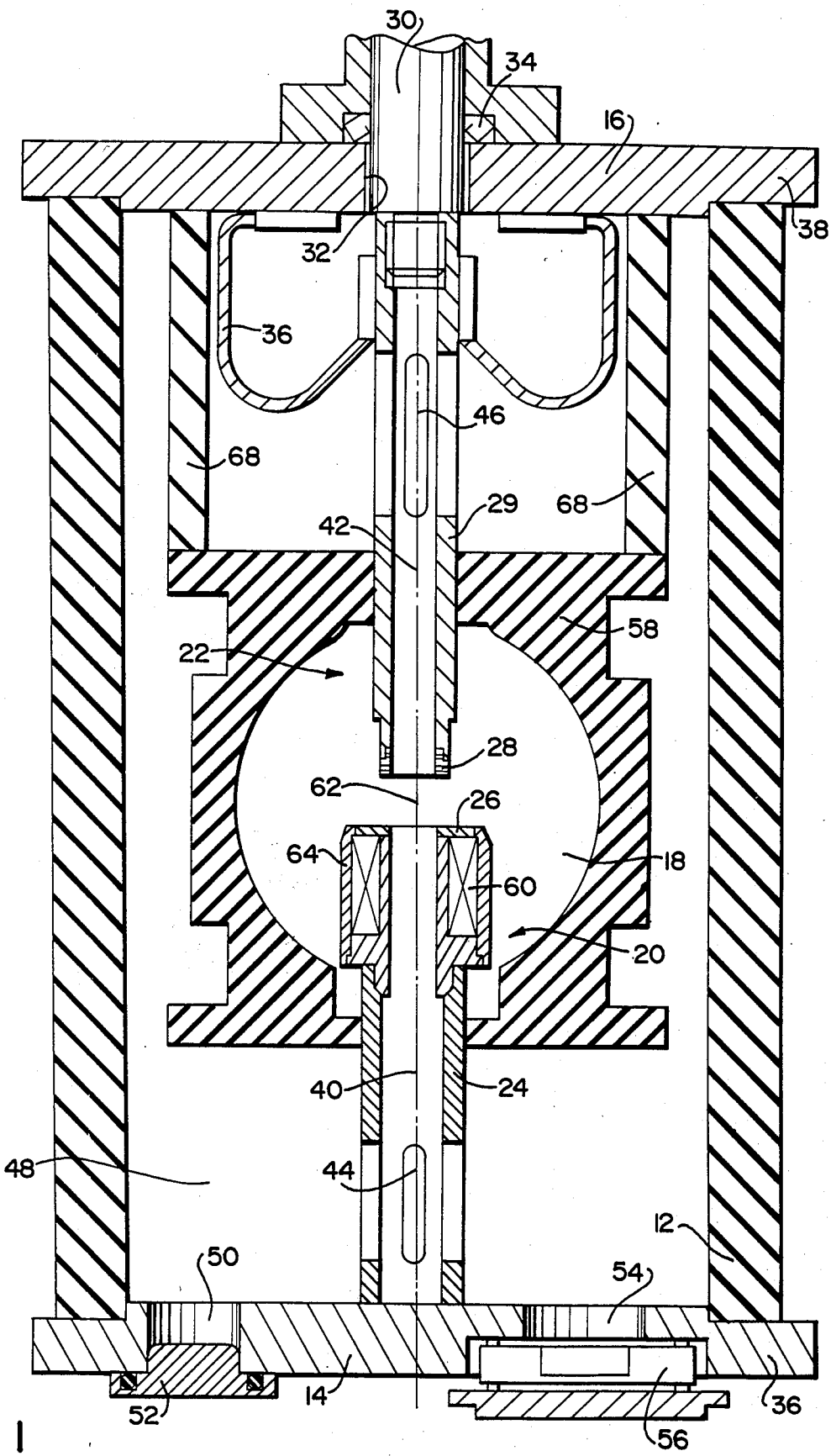

Other advantages and characteristics will become more clearly apparent from the following description of various embodiments of the invention, given as examples only and represented in the accompanying drawings, in which:

FIG. 1 is an axial cross-sectional view of a circuit breaker according to the invention, represented in the open position, FIGS. 2 to 7 show a schematic partial sectional view of several embodiments of the invention.

FIG. 1 shows a rotating arc self-expansion electrical circuit breaker 10, comprising a cylindrical-shaped insulating housing 12, sealed at opposite ends by base plates 14, 16. The housing 12 is tight and filled with high dielectric strength electronegative insulating gas, such as sulphur hexafluoride. Inside the housing 12 a divisional arc chute 18 is located which houses a system of separable coaxial contacts 20, 22. The stationary contact 20 formed by a conductor tube 24 supported by the base plate 14, is fitted at its opposite end with an electrode 26 facing an annular contact surface 28 of the moving contact 22. The latter comprises a support tube 29 mounted sliding axially in the housing 12 and securedly attached to a control rod 30 which passes through a central opening 32 in the base plate 16 fitted with a seal 34. A conducting strip 36 or any other flexible or sliding conductor provides the electrical connection between the tube 29 of the moving contact 22 and the base 16. Connection terminals 36, 38 of the pole of the circuit breaker 10 are associated with the base plates 14, 16, made of conducting material.

The two tubes 24, 29 of the stationary 20 and moving contacts 22 each comprise an internal axial outflow duct 40, 42 and radial orifices 44, 46 allowing communication between the inside of the arc chute 18 and the remaining volume of the housing constituting a discharge chamber 48. The base plate 14 has a first hole 50 blanked up by means of a plug 52, and a second hole 54 cooperating with a relief valve formed by a blow-out disk 56 in the event of abnormal overpressure inside the housing 12. The two aligned tubes 24, 29 pass tightly through the wall 58 of the arc chute 18, and the annular contact surface 28 of the sliding tube 29 cooperates by abutment in the circuit breaker closed position with the electrode 26 of the tube 24. The electrode 26 constitutes an annular arc root migration track.

Between the electrode 26 and the stationary support tube 24, magnetic means are fitted, notably a cylindrical shaped permanent magnet or electromagnetic coil 60, designed to generate a radial induction field in the separation area 62 of the contacts, so as to ensure rotation of the arc. The mechanical and electrical connection between the electrode 26 and the tube 24 is provided by a conducting bushing 64 coaxially surrounding the coil 60.

According to the invention, the wall 58 of the divisional arc chute 18 comprises a crooked internal lateral surface with nonadjusted revolution around the contacts, notably convex or concave in shape, so as to form an acoustic resonator reflecting the pressure waves inside the arc chute 18 inwardly towards the center. The revolution surface is advantageously spherical or hemispherical, so that the acoustic resonator presents a vibration antinode in the center of the sphere. The annular electrode 26 of the stationary contact 20 and the conjugate contact surface 28 of the moving contact 22 are located close to the center of the spherical arc chute 18. The wall 58 of the divisional arc chute 18 is made of an insulating material, notably epoxy resin based, or of any other material having a high reflection coefficient. A deflector (not shown) made of metallic or refractory material can be fitted against the internal face of the arc chute 18, facing the contact separation area 62. The arc chute 18 is supported by fixing means securedly attached to the base plate 16, as well as by the tube 24 fixed to the opposite base plate 14.

Operation of the self-expansion and rotating arc circuit breaker 10 according to FIG. 1 is as follows:

When the contacts 20, 22 in the center of the spherical arc chute 18 separate, the arc extends in the breaking area 62 and is drawn in rotation by the action of the magnetic field of the coil 60 or of the magnet. The heat given off by the rotating arc causes the pressure inside the arc chute 18 to rise, and the gas to flow out through the internal outflow ducts 40, 42 of the hollow contacts 20, 22 into the discharge chamber 48 in which expansion of the gas initially compressed in the arc chute 18 takes place. The inward reflection of the pressure waves on the internal wall 58 of the spherical arc chute 18 causes the gases to converge towards the contact separation area 62, and contributes effectively to centering the arc.

Figure 2:
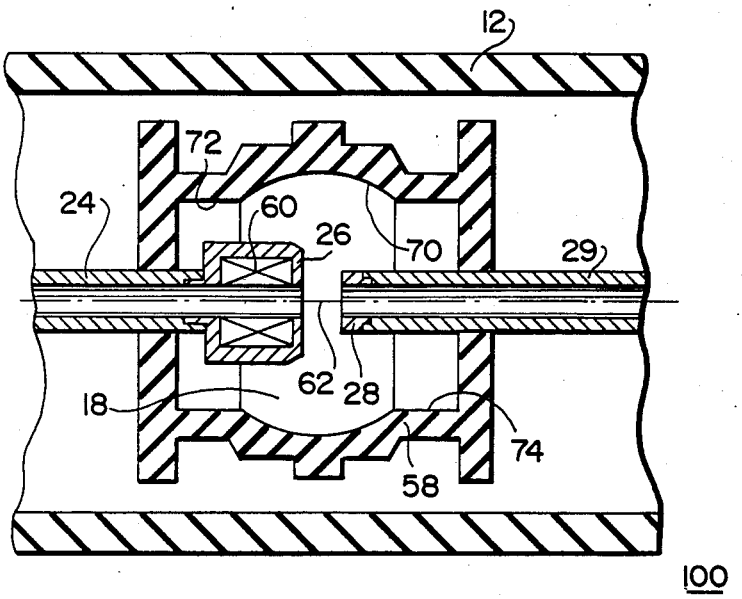

FIG. 2 shows an alternative embodiment of a circuit breaker 100, in which the same numbers designate identical parts to those of the device in FIG. 1. The shape of the wall 58 of the arc chute 18 has been modified, and comprises a central spherical sector 70 opposite the contact separation area 62, extended by two opposing cylindrical portions 72, 74.

According to the devices in FIGS. 1 and 2, only the stationary contact 20 is fitted with a permanent magnet or coil 60 to cause the arc to rotate. It is clear that a second magnet or coil (not shown) can be associated with the moving contact inside the arc chute 18, so as to impose a migration in the opposite direction of the arc roots on the annular electrodes facing the contacts 20, 22.

Figure 3:
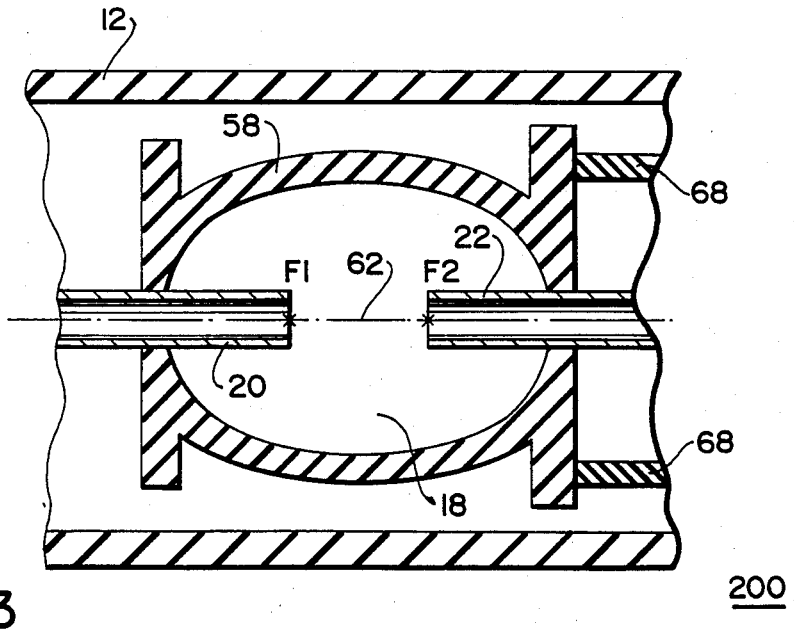
Figure 4:
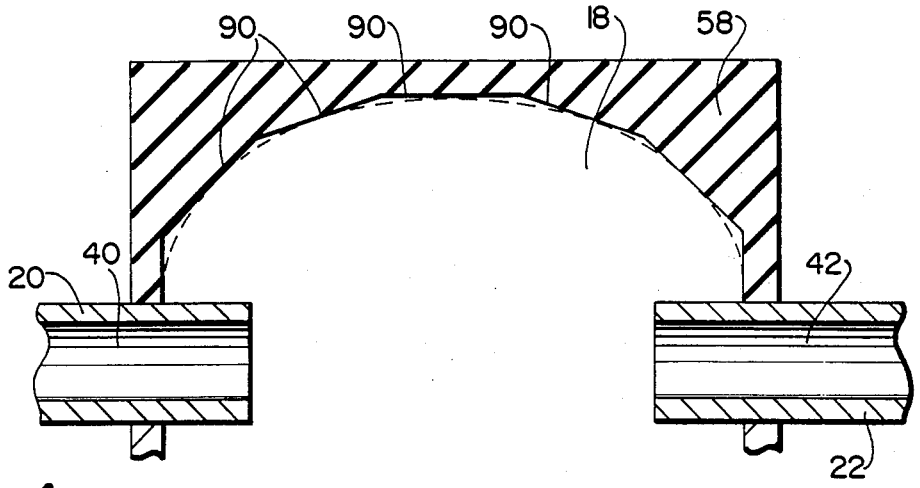

FIG. 3 represents another alternative embodiment of a self-expansion circuit breaker 200. The pressure waves on the internal wall 58 of the arc chute 18 are also sought to be turned to advantage by focalizing these waves in the contact separation area 62 by giving the arc chute an ellipsoidal shape, arranged in such a way that the contacts 20, 22 are located appreciably at the level of the two focal spots F1, F2 of the ellipse, with the circuit breaker 200 in the open position. A pressure wave emitted at one of the focal spots F1 inside the ellipsoid is reflected by the wall 58 and focalized at the other focal spot F2. This results in excellent centering of the arc in the vicinity of the electrodes. The circuit breaker 200 in FIG. 3 has been represented without magnetic arc blow-out means, but it is clear that it can be equipped with a coil or a permanent magnet ensuring arc rotation.

The circuit breaker 10, 100, 200, according to one of the FIGS. 1 to 3 can in addition be equipped with an auxiliary compression piston-cylinder blow-out device (not shown), actuated when the moving contact 22 moves to send a jet of blow-out gas to the arcing area. This pneumatic blow-out device can be incorporated either directly in the arc chute 18 or in the discharge chamber 48.

According to another alternative embodiment (not shown), the SF6 circuit breaker or switch is of the rotating arc type, but without self-expansion, comprising a single sealed housing containing a pair of separable contacts and a magnetic blow-out coil. The arc extension area is advantageously surrounded by an internal wall having a spherical or ellipsoidal shape, to ensure centering of the arc according to the longitudinal axis of revolution.

Figure 5:
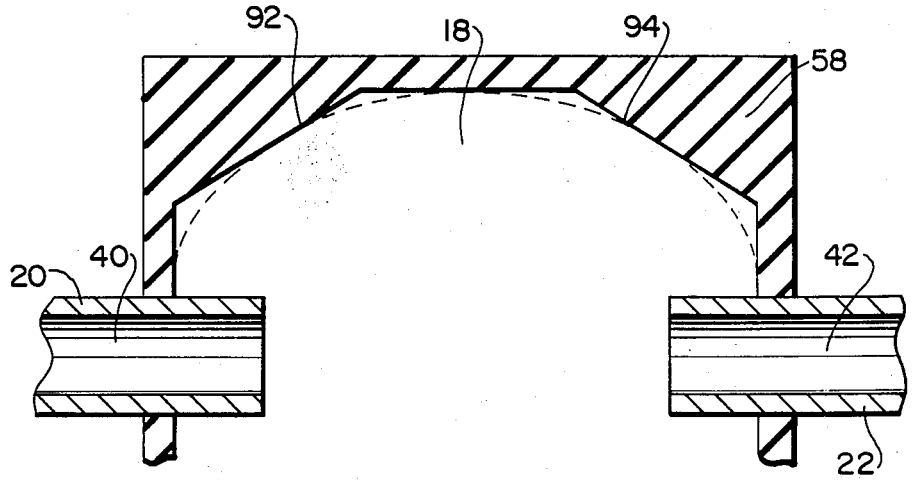
Figure 6:
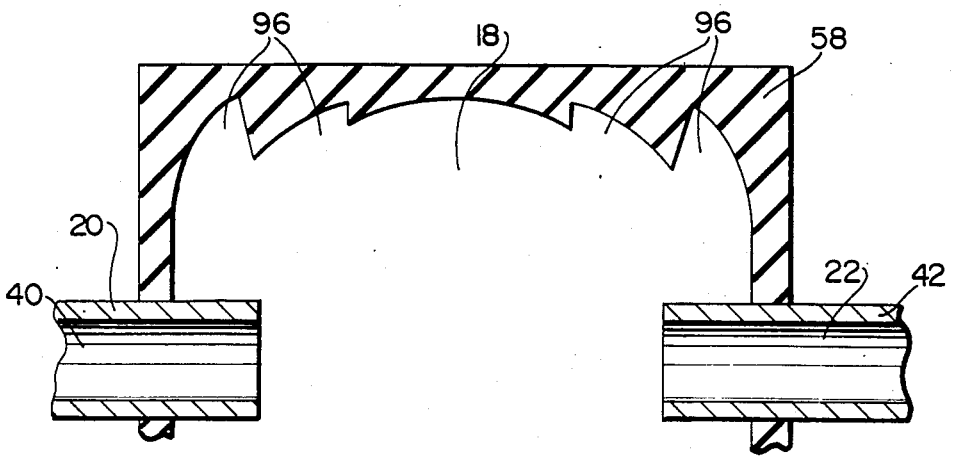
Figure 7:
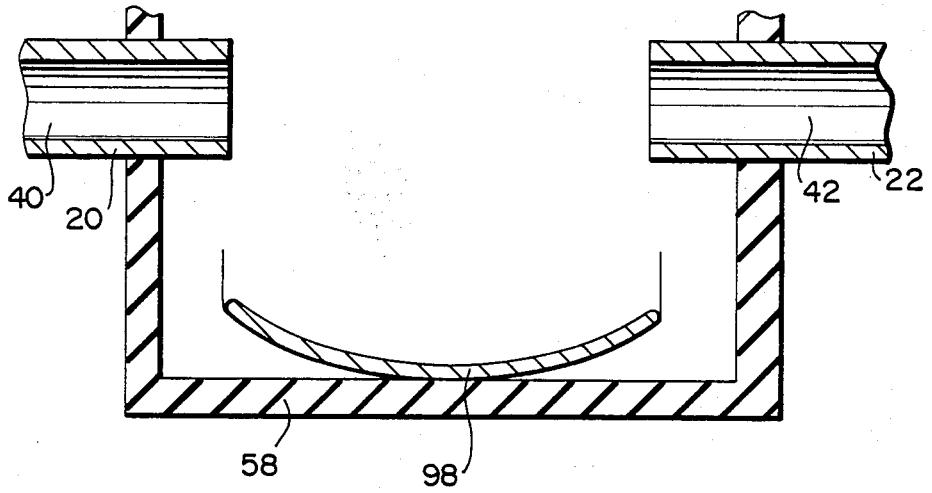

The devices in FIGS. 4 to 7 show other alternative embodiments of the arc chute 18, designed to produce focusing effects of the acoustic waves. The focusing elements can be made up of a succession of flat mirrors 90 (FIG. 4), disposed at intervals along an appreciably elliptical curve, or by juxtaposition of two opposing truncated cones 92, 94 (FIG. 5). According to FIG. 6, the internal face of the wall 58 of the arc chute 18 has a plurality of notches 96, so as to form a Fresnel lens structure, which is able to improve in addition the dielectric strength by increasing the insulation distance. The focusing elements 90, 92, 94, 96, of the devices in FIGS. 4 to 6 come advantageously from moulding with the arc chute 18 and constitute the internal face of the wall 58, but can also be constituted by independent parts 98 securedly attached inside the arc chute 18 against the wall 58. In FIG. 7, the wall 58 is cylindrical, and the part 98 or focusing element deflector has a shape adapted to constitute the acoustic resonator. The part 98 may be of a different material from that of the wall 58, so as to provide protection against pollution due to the arc, and to improve the insulation distance.

We claim:

1. Arc extinction device for self-expansion and gas insulation switch or circuit breaker, comprising:

a sealed housing filled with a high dielectric strength insulating gas, notably sulfur hexafluoride, a divisional arc chute inside said housing, a pair of separable contacts housed in said arc chute, at least one of the contacts being hollow, a gas outflow duct from said arc chute to a discharge chamber in which expansion of the gas initially compressed in the arc chute takes place under the action of the arc drawn between the contacts separated when the circuit breaker opens, and connection terminals in electrical connection with said contacts, wherein the divisional arc chute comprises in a straight line with the contact separation area a wall forming a curved side revolution surface of a non linear curve, notably convex or concave, in such a way as to form an acoustic resonator reflecting the pressure waves inwardly, causing the gases to converge towards said separation area, and that the separable contacts are located in the vicinity of the middle area of said arc chute.

2. Arc extinction device according to claim 1, wherein the wall of the arc chute has a spherical shape or a spherical cross-section surface, so that the acoustic resonator presents a vibration antinode in the center of the sphere.

3. Arc extinction device according to claim 1, wherein the wall of the arc chute has an ellipsoidal shape, and the contacts are located appreciably at the focal spots F1, F2 of the ellipse, with the circuit breaker in the open position.

4. Arc extinction device according to claim 1, comprising magnetic means located inside said arc chute so as to generate a magnetic induction field in the separation area of the contacts to impose fast rotation of the arc around the axis of rotation of the arc chute, and gas outflow duct to the discharge chamber (48) being formed by the inside of the hollow contact.

5. Arc extinction device according to one of the claim 1 wherein the wall of the arc chute is made of an insulating material having a high reflection coefficient.

6. Arc extinction device according to claim 1, comprising a deflector made of metallic or refractory material, constituting an acoustic resonator being fixed against the internal wall of the arc chute, said deflector having a convex or concave lateral revolution surface, notably spherical, elliptical or truncated.

7. Arc extinction device according to claim 4, wherein the magnetic means are arranged coaxially with said separable contacts so as to impose a migration in the opposite direction of the arc roots on the facing annular electrodes associated with said contacts, the lines of said magnetic field extending transversely in the separation area.

8. Arc extinction device according to claim 1, wherein each of said pair of separable contacts are aligned along the axis of rotation of said arc chute, each contact being hollow and constituting a tubular overflow duct, thereby enabling a double expansion of the gases to the discharge chamber.

9. Arc extinction device according to claim 4, having a piston cylinder gas compression device fitted inside said arc chute, the separation of the contacts actuating said gas compression device so as to send an auxiliary jet of blow-out gas to the separation area.

* * * * *